US005672451A

United States Patent [19]

Tam et al.

[11] Patent Number: 5,672,451

[45] Date of Patent: Sep. 30, 1997

[54] MIGRATION IMAGING MEMBERS

[75] Inventors: Man C. Tam; Liqin Chen; Edward G. Zwartz; Daniel Bihon, all of Mississauga; Marie-Eve Perron, Montreal, all of Canada

[73] Assignee: Xerox Corporation, Stamford, Conn.

[21] Appl. No.: 630,296

[22] Filed: Apr. 11, 1996

[51] Int. Cl.[6] ..... G03G 17/10

[52] U.S. Cl. ..... 430/41; 430/49

[58] Field of Search ..... 430/58, 64, 96, 430/41, 49

[56] References Cited

U.S. PATENT DOCUMENTS

| | | | |
|---|---|---|---|
| 4,464,450 | 8/1984 | Teuscher | 430/59 |
| 4,933,244 | 6/1990 | Teuscher et al. | 430/96 |
| 5,102,756 | 4/1992 | Vincett et al. | 430/41 |
| 5,215,838 | 6/1993 | Tam et al. | 430/41 |

*Primary Examiner*—John Goodrow
*Attorney, Agent, or Firm*—Judith L. Byorick

[57] ABSTRACT

Disclosed is a migration imaging member which comprises (a) a substrate, (b) a conductive layer comprising indium tin oxide dispersed in a polymeric binder, (c) a siloxane film charge blocking layer comprising a hydrolysis reaction product of a silane of the formula wherein $R_1$ is an alkylidene group, $R_2$ and $R_3$ are each, independent of the other, a hydrogen atom, an alkyl group, a phenyl group, or a poly(ethyleneamino) group, and $R_4$, $R_5$, and $R_6$ are each, independent of the others, alkyl groups, said siloxane having reactive hydroxyl and ammonium groups attached to silicon atoms, and (d) a softenable layer comprising a softenable material and a photosensitive migration marking material. Optionally an antistatic layer comprising indium tin oxide dispersed in a polymeric binder is situated on the surface of the substrate spaced from the softenable layer.

23 Claims, 1 Drawing Sheet

MIGRATION IMAGING MEMBERS

BACKGROUND OF THE INVENTION

The present invention is directed to migration imaging members. One embodiment of the present invention is directed to a migration imaging member which comprises (a) a substrate, (b) a conductive layer comprising indium tin oxide dispersed in a polymeric binder, (c) a siloxane film charge blocking layer comprising a hydrolysis reaction product of a silane of the formula

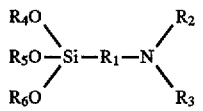

wherein $R_1$ is an alkylidene group, $R_2$ and $R_3$ are each, independent of the other, a hydrogen atom, an alkyl group, a phenyl group, or a poly(ethyleneamino) group, and $R_4$, $R_5$, and $R_6$ are each, independent of the others, alkyl groups, said siloxane having reactive hydroxyl and ammonium groups attached to silicon atoms, and (d) a softenable layer comprising a softenable material and a photosensitive migration marking material. Optionally an antistatic layer comprising indium tin oxide dispersed in a polymeric binder is situated on the surface of the substrate spaced from the softenable layer.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue filter which conforms to ANSI PH 2.19 status T response. The expression "optical density" as used herein is intended to mean "transmission optical density" and is represented by the formula:

$$D=\log_{10}[I_O/I]$$

where I is the transmitted light intensity and $I_O$ is the incident light intensity. For the purpose of this invention, all values of transmission optical density given in this invention include the substrate density of about 0.2 which is the typical density of a metallized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. No. 4,536,458 and U.S. Pat. No. 4,536,457.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

U.S. Pat. No. 5,215,838 (Tam et al.), the disclosure of which is totally incorporated herein by reference, discloses a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

U.S. Pat. No. 4,464,450 (Teuscher), the disclosure of which is totally incorporated herein by reference, discloses an electrostatographic imaging member having two electrically operative layers including a charge transport layer and a charge generating layer, the electrically operative layers overlying a siloxane film coated on a metal oxide layer of a metal conductive anode, said siloxane film comprising a reaction product of a hydrolyzed silane having the following general formula:

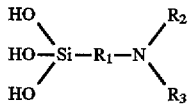

wherein $R_1$ is an alkylidene group containing 1 to 20 carbon atoms, and $R_2$ and $R_3$ are independently selected from the group consisting of H, a lower alkyl group containing 1 to 3 carbon atoms, a phenyl group, and a poly(ethylene-amino) group, said siloxane having reactive OH and ammonium groups attached to silicon atoms.

Copending application U.S. Ser. No. 08/413,667, now U.S. Pat. No. 5,532,102 filed Mar. 30, 1995, entitled "Improved Apparatus and Process for Preparation of Migration Imaging Members," with the named inventors Philip H. Soden and Arnold L. Pundsack, the disclosure of which is totally incorporated herein by reference, discloses an apparatus for evaporation of a vacuum evaporatable material onto a substrate, said apparatus comprising (a) a walled container for the vacuum evaporatable material having a plurality of apertures in a surface thereof, said apertures being configured so that the vacuum evaporatable material is uniformly deposited onto the substrate; and (b) a source of heat sufficient to effect evaporation of the vacuum evaporatable material from the container through the apertures onto the substrate, wherein the surface of the container having the plurality of apertures therein is maintained at a temperature equal to or greater than the temperature of the vacuum evaporatable material.

Copending application U.S. Ser. No. 08/353,461, now U.S. Pat. No. 5,576,629 filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, William W. Limburg, John F. Yanus, Damodar M. Pal, and Dale S. Renfer, the disclosure of which is totally incorporated herein by reference, discloses a migration imaging member comprising a substrate, a first softenable layer comprising a first softenable material and a first migration marking material contained at or near the surface of the first softenable layer spaced from the substrate, and a second softenable layer comprising a second softenable material and a second migration marking material. Also disclosed is a migration imaging process employing the aforesaid imaging member.

Copending application U.S. Ser. No. 08/432,401, now U.S. Pat. No. 5,563,013 filed May 1, 1995, entitled "Pre-Sensitized Infrared or Red Light Sensitive Migration Imaging Members," with the named inventor Man C. Tam, the disclosure of which is totally incorporated herein by reference, discloses a process which comprises (1) providing a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light sensitive pigment is predominantly sensitive contained at or near the surface of the softenable layer, said infrared or red light radiation sensitive layer being situated between the substrate and the softenable layer; (2) uniformly charging the imaging member; (3) subsequent to step (2), uniformly exposing the imaging member to activating radiation at a wavelength to which the migration marking material is sensitive; (4) subsequent to step (3), neutralizing charge on the surface of the imaging member spaced from the substrate; (5) subsequent to step (4), exposing the imaging member to infrared or red light radiation at a wavelength to which the infrared or red light radiation sensitive pigment is sensitive in an imagewise pattern, thereby forming an electrostatic latent image on the imaging member, wherein step (5) takes place at least 2 hours after completion of step (4); (6) subsequent to step (5), causing the softenable material to soften, thereby enabling the migration marking material to migrate through the softenable material toward the substrate in an imagewise pattern.

Copending application U.S. Ser. No. 08/432,291, filed May 1, 1995, entitled "Improved Migration Imaging Process," with the named inventors Man C. Tam and Edward G. Zwartz, the disclosure of which is totally incorporated herein by reference, discloses a process which comprises (a) providing a migration imaging member comprising (1) a substrate, (2) an infrared or red light radiation sensitive layer comprising a pigment predominantly sensitive to infrared or red light radiation, and (3) a softenable layer comprising a softenable material, a charge transport material, and a photosensitive migration marking material predominantly sensitive to radiation at a wavelength other than that to which the infrared or red light sensitive pigment is predominantly sensitive; (b) uniformly charging the imaging member; (c) subsequent to step (b), uniformly exposing the charged imaging member to a source of activating radiation with a wavelength to which the migration marking material is sensitive, wherein a filter comprising the infrared or red light radiation sensitive pigment is situated between the radiation source and the imaging member; (d) subsequent to step (b), exposing the imaging member to infrared or red light radiation at a wavelength to which the infrared or red light radiation sensitive pigment is sensitive in an imagewise pattern. thereby forming an electrostatic latent image on the imaging member; and (e) subsequent to steps (c) and (d), causing the softenable material to soften, thereby enabling the migration marking material to migrate through the softenable material toward the substrate in an imagewise pattern.

Copending application U.S. Ser. No. 08/432,448, filed May 1, 1995, entitled "Improved Overcoated Migration Imaging Members," with the named inventors Shadi L. Malhotra and Arthur Y. Jones, the disclosure of which is totally incorporated herein by reference, discloses a migration imaging member comprising (1) a substrate, (2) a softenable layer situated on the substrate, said softenable layer comprising a softenable material and a photosensitive migration marking material, and (3) an overcoating layer situated on the surface of the softenable layer spaced from the substrate, said overcoating layer comprising a material selected from the group consisting of: (a) polyacrylic acids, (b) poly (hydroxyalkylmethacrylates), (c) poly (hydroxyalkylacrylacetate copolymers, (e) vinyl acetate copolymers, (e) vinyl alcohol-vinyl butyral copolymers, (f) alkyl celluloses, (g) aryl celluloses, (h) hydroxyalkyl cellulose acrylates, (i) hydroxyaryl cellulose acrylates, (j) hydroxyalkyl cellulose methacrylates, (k) hydroxyaryl cellulose methacrylates, (I) cellulose-acrylamide adducts, (m) poly (vinyl butyrals), (n) cyanoethylated celluloses, (o) cellulose acetate hydrogen phthalates, (p) hydroxypropylmethyl cellulose phthalates, (q) hydroxypropyl methyl cellulose succinates, (r) cellulose triacetates, (s) vinyl pyrrolidone-vinyl acetate copolymers, (t) vinyl chloride-vinylacetate-vinyl alcohol terpolymers, (u) ethylene-maleic anhydride copolymers, (v) styrene-maleic anhydride copolymers, (w) styrene-allyl alcohol copolymers, (x) poly (4-vinylpyridines), (y) polyester latexes, (z) vinyl chloride latexes, (aa) ethylene-vinyl chloride copolymer emulsions, (bb) poly vinyl acetate homopolymer emulsions, (cc) carboxylated vinyl acetate emulsion resins, (dd) vinyl acetate copolymer latexes, (ee) ethylene-vinyl acetate copolymer emulsions, (ff) acrylic-vinyl acetate copolymer emulsions, (gg) vinyl acrylic terpolymer latexes, (hh) acrylic emulsion latexes, (ii) polystyrene latexes, (ii) styrene-butadiene latexes, (kk) butadiene-acrylonitrile latexes, (ll) butadiene-acrylonitrile-styrene terpolymer latexes, (mm) propylene-acrylic acid copolymers, (nn) propylene-ethylene-acrylic acid terpolymers, (oo) poly (vinyl methyl ketones), (pp) poly (trimethyl hexamethylene) terephthalamides, (qq) chlorinated polypropylenes, (rr) poly (hexamethylene sebacates), (ss) poly(ethylene succinates), (tt) poly (caprolactams), (uu) poly (hexamethylene adipamides), (vv) poly (hexamethylene nonaneamides), (ww) poly (hexamethylene sebacamides), (xx) poly (hexamethylene dodecane diamides), (yy) poly (undecanoamides), (zz) poly (lauryllactams), (aaa) ethylene-methacrylic acid ionomers, and (bbb) mixtures thereof.

Copending application U.S. Ser. No. 08/432,380, now U.S. Pat. No. 5,534,374 filed May 1, 1995, entitled "Improved Migration Imaging Members," with the named inventor Shadi L. Malhotra, the disclosure of which is totally incorporated herein by reference, discloses a migration imaging member comprising (a) a substrate, (b) a softenable layer situated on one surface of the substrate, said softenable layer comprising a softenable material and a photosensitive migration marking material, and (c) an antistatic layer situated on the surface of the substrate opposite to the surface in contact with the softenable layer.

Copending application U.S. Ser. No. 08/442,227, now U.S. Pat. No. 5,563,014 filed May 15, 1995, entitled "Improved Migration Imaging Members," with the named inventors Shadi L. Malhotra, Liqin Chen, and Marie-Eve Perron, the disclosure of which is totally incorporated herein by reference, discloses a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member. Also disclosed is a process which comprises (1) providing a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member; (2) uniformly charging the imaging member; (3) subsequent to step (2), exposing the charged imaging member to activating radiation at a wavelength to which the migration marking material is sensitive; (4) subsequent to step (3), causing the softenable material to soften and enabling a first portion of the migration marking material to migrate through the softenable material toward the substrate in an imagewise pattern while a second portion of the migration marking material remains substantially unmigrated within the softenable layer, wherein subsequent to migration of the first portion of migration marking material, either (a) the first portion of migration marking material contacts the transparentizing agent and the second portion of migration marking material does not contact the transparentizing agent; or (b) the second portion of migration marking material contacts the transparentizing agent and the first portion of migration marking material does not contact the transparentizing agent.

Copending application U.S. Ser. No. 08/441,360 now U.S. Pat. No. 5,514,505, filed May 15, 1995, entitled "Method For Obtaining Improved Image Contrast In Migration Imaging Members," with the named inventors William W. Limburg, Joseph Mammino, George Liebermann, Clifford H. Griffiths, Michael M. Shahin, Shadi L. Malhotra, Liqin Chen, and Marie-Eve Perron, the disclosure of which is totally incorporated herein by reference, discloses a process which comprises (a) providing a migration imaging member comprising (1) a substrate and (2) a softenable layer comprising a softenable material and a photosensitive migration marking material present in the softenable layer as a monolayer of particles situated at or near the surface of the softenable layer spaced from the substrate; (b) uniformly charging the imaging member; (3) imagewise exposing the charged imaging member to activating radiation at a wavelength to which the migration marking material is sensitive; (d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer; and (e) contacting the second portion of the migration marking material with a transparentizing agent which transparentizes migration marking material.

Copending application U.S. Ser. No. 08/523,574 now U.S. Pat. No. 5,580,689, filed Sep. 5, 1995, entitled "Improved Migration Imaging Members," with the named inventors Allan K. Chen, Arnold L. Pundsack, Enrique Levy, Eric R. Endrizzi, Richard N. Edwards, Arthur Y. Jones, and Edward G. Zwartz, the disclosure of which is totally incorporated herein by reference, discloses a migration imaging member comprising a substrate and a softenable layer, said softenable layer comprising a softenable material, a pigment predominantly sensitive to infrared or red light radiation, and a migration marking material predominantly sensitive to radiation at a wavelength other than that to which the infrared or red light radiation sensitive pigment is sensitive contained at least at or near the surface of the softenable layer spaced from the substrate.

Copending application U.S. Ser. No. 08/537,989 now U.S. Pat. No. 5,538,825, filed Oct. 2, 1995, entitled "Printing Plate Preparation Process," with the named inventors Arnold L. Pundsack. Hardy Sonnenberg, and Man C. Tam, the disclosure of which is totally incorporated herein by reference, discloses a process which comprises (a) providing a migration imaging member which comprises a substrate and a softenable layer comprising a softenable material and a photosensitive migration marking material; (b) providing a printing plate precursor which comprises a base layer and a layer of photosensitive material selected from the group consisting of photohardenable materials and photosoftenable materials; (c) placing the softenable layer of the migration imaging member in contact with the layer of photosensitive material of the printing plate precursor and applying heat and pressure to the migration imaging member and printing plate precursor, thereby causing the softenable layer of the migration imaging member to adhere to the layer of photosensitive material of the printing plate precursor; (d) uniformly charging the migration imaging member; (e) subsequent to step (d), exposing the charged imaging member to activating radiation at a wavelength to which the migration marking material is sensitive; (f) subsequent to step (e), causing the softenable material to soften and enabling the migration marking material to migrate through the softenable material in an imagewise pattern, thereby resulting in the layer of softenable material becoming transmissive to light in areas where the migration marking material has migrated and remaining nontransmissive to light in areas where the migration marking material has not migrated; (g) subsequent to step (f), uniformly exposing the migration imaging member and the printing plate precursor to radiation at a wavelength to which the photosensitive material on the printing plate precursor is sensitive, thereby causing the photosensitive material on the printing plate precursor to harden or soften in areas situated contiguous with light-transmissive areas of the softenable layer, thereby forming an imaged printing plate; and (h) subsequent to step (g), removing the migration imaging member from the imaged printing plate.

While known apparatus and processes are suitable for their intended purposes, a need remains for improved migration imaging members. A need further remains for migration imaging members particularly suitable for use as masks for exposing the photosensitive material in a printing plate or a color proofing film. Additionally, there is a need for migration imaging members particularly suitable for use as masks for exposing the photosensitive material in a printing plate or color proofing film with ultraviolet radiation. There is also a need for migration imaging members which enable lowered $D_{min}$ values. In addition, a need remains for migration imaging members which, when used as masks for exposing the photosensitive material in a printing plate or color proofing film, enable reduced exposure times. Further, a need remains for migration imaging members which, when used as masks for exposing the photosensitive material in a printing plate or color proofing film, enable reduced lamp intensities for exposure. Additionally, a need remains for migration imaging members having conductive layers with improved uniformity and few or no pinholes (which lead to image defects). There is also a need for migration imaging members which enable uniform $D_{min}$ values when imaged. There is a further need for migration imaging members which enable color imaging processes that exhibit reduced or no undesirable color shifting. Further, there is a need for migration imaging members which, when placed in stacks or rolls, do not exhibit blocking. Additionally, there is a need for migration imaging members with improved mechanical characteristics. There is also a need for migration imaging members with reduced manufacturing costs. Additionally, a need remains for migration imaging members which exhibit improved adhesion of the softenable layer to the substrate.

SUMMARY OF THE INVENTION

It is an object of the present invention to provide migration imaging members with the above noted advantages.

It is another object of the present invention to provide migration imaging members particularly suitable for use as masks for exposing the photosensitive material in a printing plate or a color proofing film.

It is yet another object of the present invention to provide migration imaging members particularly suitable for use as masks for exposing the photosensitive material in a printing plate or color proofing film with ultraviolet radiation.

It is still another object of the present invention to provide migration imaging members which enable lowered $D_{min}$ values.

Another object of the present invention is to provide migration imaging members which, when used as masks for exposing the photosensitive material in a printing plate or color proofing film, enable reduced exposure times.

Yet another object of the present invention is to provide migration imaging members which, when used as masks for exposing the photosensitive material in a printing plate or color proofing film, enable reduced lamp intensities for exposure.

Still another object of the present invention is to provide migration imaging members having conductive layers with improved uniformity and few or no pinholes (which lead to image defects).

It is another object of the present invention to provide migration imaging members which enable uniform $D_{min}$ values when imaged.

It is yet another object of the present invention to provide migration imaging members which enable color imaging processes that exhibit reduced or no undesirable color shifting.

It is still another object of the present invention to provide migration imaging members which, when placed in stacks or rolls, do not exhibit blocking.

Another object of the present invention is to provide migration imaging members with improved mechanical characteristics.

Yet another object of the present invention is to provide migration imaging members with reduced manufacturing costs.

It is another object of the present invention to provide migration imaging members which exhibit improved adhesion of the softenable layer to the substrate.

These and other objects of the present invention (or specific embodiments thereof) can be achieved by providing a migration imaging member which comprises (a) a substrate, (b) a conductive layer comprising indium tin oxide dispersed in a polymeric binder, (c) a siloxane film charge blocking layer comprising a hydrolysis reaction product of a silane of the formula

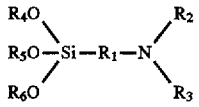

wherein $R_1$ is an alkylidene group, $R_2$ and $R_3$ are each, independent of the other, a hydrogen atom, an alkyl group, a phenyl group, or a poly(ethyleneamino) group, and $R_4$,$R_5$, and $R_6$ are each, independent of the others, alkyl groups, said siloxane having reactive hydroxyl and ammonium groups attached to silicon atoms, and (d) a softenable layer comprising a softenable material and a photosensitive migration marking material. Optionally an antistatic layer comprising indium tin oxide dispersed in a polymeric binder is situated on the surface of the substrate spaced from the softenable layer.

DETAILED DESCRIPTION OF THE INVENTION

Figure 1:
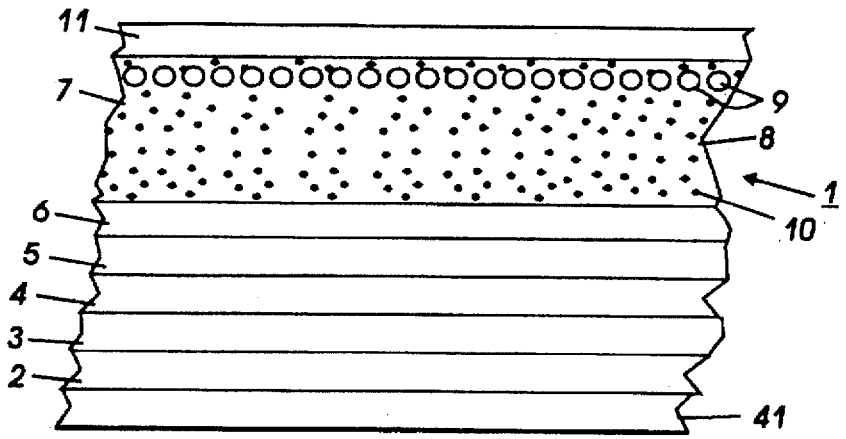
FIG. 1 illustrates schematically one migration imaging member suitable for the present invention.

An example of a migration imaging member suitable for the present invention is illustrated schematically in FIG. 1. As illustrated schematically in FIG. 1, migration imaging member 1 comprises a substrate 2, a conductive layer 3 comprising indium tin oxide dispersed in a polymeric binder, an optional adhesive layer 4, a siloxane film charge blocking layer 5, an optional charge transport layer 6, and a softenable layer 7, said softenable layer 7 comprising softenable material 8, migration marking material 9 situated at or near the surface of the layer spaced from the substrate, and optional charge transport material 10 dispersed throughout softenable material 8. Optional overcoating layer 11 is situated on the surface of softenable layer 7 spaced from the substrate 2. Optional antistatic coating 41 is situated on the surface of substrate 2 opposite to that coated with softenable layer 7. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating, with transparent materials being preferred. The substrate can be of any suitable material, such as glass, plastic, polyesters such as Mylar® (available from Du Pont) or Melinex® 442 (available from ICI Americas, Inc.), polyethylene terephthalate, and the like. The substrate has any effective thickness, typically from about 6 to about 250 microns, and preferably from about 50 to about 200 microns, although the thickness can be outside these ranges.

The conductive layer comprises indium tin oxide dispersed in a polymeric binder. Any suitable or desired binder may be selected. Examples of suitable polymeric binders include gelatin, polyvinyl alcohol, polyvinyl acetate, carboxylated polyvinyl acetate, polyvinyl acetal, polyvinyl chloride, polyvinyl phthalate, polyvinyl methyl ethyl maleic anhydride, polymethylmethacrylate, polyvinyl acetal phthalate, polystyrenebutadiene-acrylonitrile, polyvinyl butyral, polystyrene-maleic acid, polyvinylidene chloride-acrylonitrile, polymethylmethacrylatemethacrylic acid, polybutyl methacrylatemethacrylic acid, cellulose acetate, cellulose acetate-butyrate, cellulose acetate-phthalate, cellulose ethylether phthalate, methylcellulose, ethylcellulose, polymethylacrylatevinylidene chloride-itaconic acid, poly-2-vinyl pyridine, celluloseacetate diethylamino-acetate, polyvinyl methyl ketone, polyvinyl acetophenone, polyvinyl benzophenone, polyvinylmethyl-acrylatemethacrylic acid, polyvinyl acetate maleic anhydride, polyacrylonitrile acrylic acid, poly-4-vinyl pyridine, carboxylic esters of rosin lactones, polystyrene, cellulose nitrate, polyurethane resins, polyamide resins, phenolic resins, urea resins, melamine resins, ethyl cellulose diethylaminoacetate, other basic polymers, polybasic acid polymers, polyesters, epoxy resins, alkyds, and the like, as well as mixtures thereof. The conductive layer contains indium tin oxide and the polymeric binder in any effective relative amounts. Typically, the indium tin oxide is present in an amount of from about 1 to about 30 percent by weight of the conductive layer, and preferably from about 3 to about 15 percent by weight of the conductive layer, and the binder is present in an amount of from 70 to about 99 percent by weight of the conductive layer, and preferably from about 85 to about 97 percent by weight of the conductive layer, although the amounts can be outside these ranges. Higher amounts of indium tin oxide with respect to the binder will result in greater conductivity of the coating. Indium tin oxide is commercially available, from, for example, Aldrich Chemical Co., Milwaukee, Wis. The conductive layer is of any effective or desired resistance. Typically the resistance of the conductive layer is from about $5\times10^5$ to about $2\times10^{11}$ ohm/cm$^2$, and preferably from about $5\times10^5$ to about $1\times10^7$ ohm/cm$^2$, although the resistance can be outside this range. The conductive layer is of any suitable or desired thickness; typically the conductive layer has a thickness of from about 0.4 to about 4 microns, and preferably from about 0.4 to about 1 micron, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butyl methacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrenevinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, preferably from about 2 to about 25 microns, and more preferably from about 2 to about 10 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein reference.

If desired, two or more softenable layers, each containing migration marking particles, can be present in the imaging member as disclosed in copending application U.S. Ser. No. 08/353,461, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, William W. Limburg, John F. Yanus, Damodar M. Pal, and Dale S. Renfer, the disclosure of which is totally incorporated herein by reference.

The softenable layer of the migration imaging member optionally contains a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, and U.S. Pat. No. 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'- diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Pat. No. 1,058,836, German Pat. No. 1,060,260, and German Pat. No. 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. No. 4,150,987, U.S. Pat. No. 4,385,106, U.S. Pat. No. 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4described in U.S. Pat. No. 3,895,944, the disclosure of which is totally incorporated herein by reference.

Tri-substituted methanes such as alkyl-bis(N,N-dialkylaminoaryl)methane, cycloallcyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having the formula

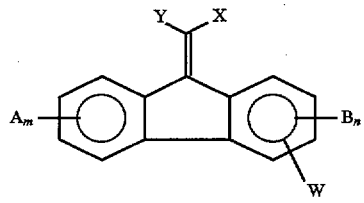

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene) malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7--trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

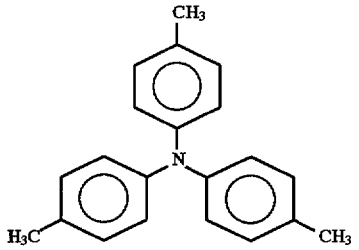

and the like, as disclosed in, for example, U.S. Pat. No. 3,240,597 and U.S. Pat. No. 3,180,730, the disclosures of which are totally incorporated herein by reference, and substituted diarylmethane and triarylmethane compounds, including bis-(4-diethylamino-2-methylphenyl) phenylmethane, of the formula

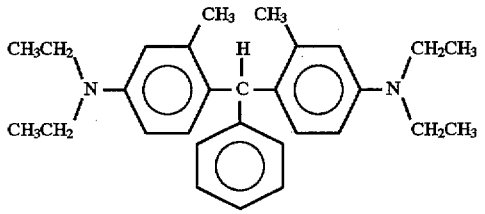

and the like, as disclosed in, for example, U.S. Pat. No. 4,082,551, U.S. Pat. No. 3,755,310, U.S. Pat. No. 3,647,431, British Patent 984,965, British Patent 980,879, and British Patent 1,141,666, the disclosure of which are totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

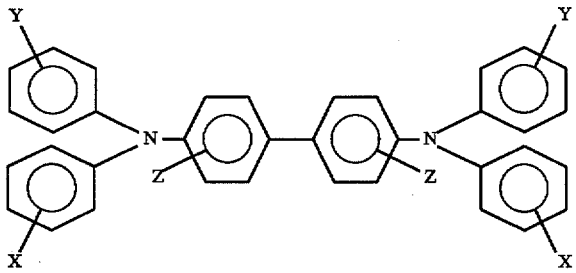

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3"-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DuPont 49000 (available from E. I. dupont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The charge blocking layer comprises a siloxane or hydrolyzed silane having the general formula

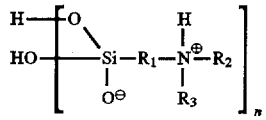

or

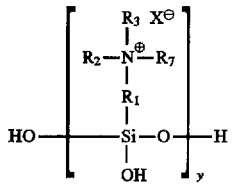

or mixtures thereof, wherein $R_1$ is an alkylidene group, preferably with from 1 to about 20 carbon atoms, $R_2$ and $R_3$ are each, independent of the other, a hydrogen atom, an alkyl group, preferably with from 1 to about 3 carbon atoms, a phenyl group, or a poly(ethylene-amino) group, $R_7$ is a hydrogen atom, an alkyl group, preferably with from 1 to about 3 carbon atoms, or a phenyl group, X is an anion from an acid or acidic salt, n is 1,2, 3, or 4, and y is 1,2, 3, or 4. The material is formed by hydrolyzing a hydrolyzable silane having the general formula

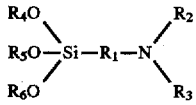

wherein $R_1$ is an alkylidene group, preferably with from 1 to about 20 carbon atoms, $R_2$ and $R_3$ are each, independent of the other, a hydrogen atom, an alkyl group, preferably with from 1 to about 3 carbon atoms, a phenyl group, or a poly(ethylene-amino) group, and $R_4$,$R_5$, and $R_6$ are each, independent of the others, alkyl groups, preferably with from 1 to about 4 carbon atoms. Examples of hydrolyzable silanes include 3-aminopropyl triethoxy silane, N-aminoethyl-3-aminopropyl trimethoxy silane, 3-aminopropyl trimethoxy silane, (N,N'-dimethyl-3-amino) propyl triethoxysilane, (N,N'-diethyl-3-amino) propyl trimethoxysilane, N,N'-dimethylamino phenyl triethoxy silane, N-phenyl aminopropyl trimethoxy silane, N-methyl aminopropyl trimethoxy silane, trimethoxy silylpropyl-diethylene triamine, bis (2-hydroxyethyl) aminopropyl triethoxy silane, N-trimethoxysilyl propyl-N,N-dimethyl ammonium acetate, N-trimethoxysilylpropyl-N,N,N-trimethyl chloride, and the like. Specific examples of materials suitable for the charge blocking layer include 3-aminopropyl triethoxy silane (gamma APS), 3-aminopropyl trimethoxy silane, both available from Aldrich Chemical Co., Milwaukee, Wis., and the like. Further information regarding charge blocking materials of this type is disclosed in, for example, U.S. Pat. No. 4,464,450, the disclosure of which is totally incorporated herein by reference.

The silane is hydrolyzed by admixing the silane with sufficient water to hydrolyze the alkoxy groups attached to the silicon atom. The aqueous solution formed thereby can be coated onto the imaging member. Preferred solutions contain from about 0.05 to about 1.5 percent by weight silane, although the amount can be outside this range. The solution preferably is maintained at a pH of from about 4 to about 10. Preferred reaction temperatures are from about 100° to about 150° C., although the temperature can be outside this range. The hydrolyzed silane can also be applied to the migration imaging member in another solvent, such as methanol, ethanol, water, or the like, as well as mixtures thereof.

Any desired or suitable technique can be used to apply the hydrolyzed silane solution to the imaging member. Typical application techniques include draw bar coating, spray coating, extrusion, dip coating, gravure roll coating, wire-wound rod coating, air knife coating, and the like. Alternatively, the unhydrolyzed silane can be applied to the imaging member, followed by hydrolysis of the silane by any desired method, such as treatment with water vapor or the like. Drying of the hydrolized silane preferably is carried out at temperatures above room temperature. After drying, the siloxane reaction product film formed from the hydrolyzed silane contains larger molecules, in which n is equal to or greater than 6; the reaction product of the hydrolyzed silane may be linear, partially crosslinked, a dimer, a trimer, or the like. The charge blocking layer is of any effective thickness, typically from about 0.005 to about 2 microns, and preferably from about 0.025 to about 1 micron, although the thickness can be outside these ranges.

Figure 2:
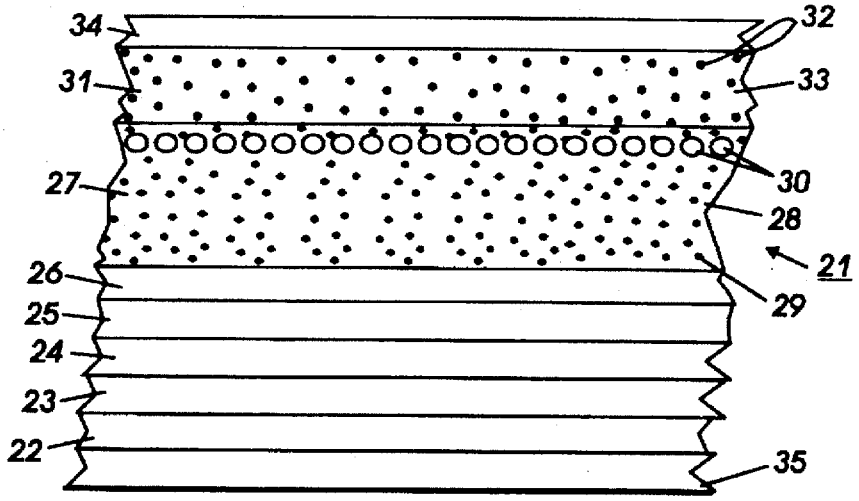
FIG. 2 illustrates schematically an infrared or red-light sensitive migration imaging member suitable for the present invention.

As illustrated schematically in FIG. 2, migration imaging member 21 comprises in the order shown a substrate 22, a conductive layer 23 comprising indium tin oxide dispersed in a polymeric binder, an optional adhesive layer 24, a siloxane film charge blocking layer 25, an optional charge transport layer 26, a softenable layer 27, said softenable layer 27 comprising softenable material 28, charge transport material 29, and migration marking material 30 situated at or near the surface of the layer spaced from the substrate, and an infrared or red light radiation sensitive layer 31 situated on softenable layer 27 comprising infrared or red light radiation sensitive pigment particles 32 optionally dispersed in polymeric binder 33. Alternatively (not shown), infrared or red light radiation sensitive layer 31 can comprise infrared or red light radiation sensitive pigment particles 32 directly deposited as a layer by, for example, vacuum evaporation techniques or other coating methods. Optional overcoating layer 34 is situated on the surface of imaging member 21 spaced from the substrate 22. Optional antistatic layer 35 is situated on the surface of substrate 22 opposite to that coated with softenable layer 27.

Figure 3:
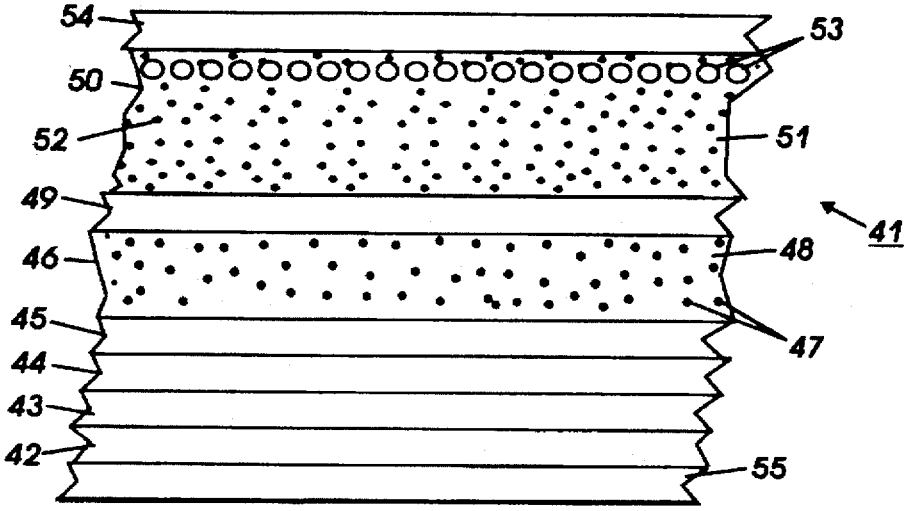
FIG. 3 illustrates schematically another infrared or red-light sensitive migration imaging member suitable for the present invention.

As illustrated schematically in FIG. 3, migration imaging member 41 comprises in the order shown a substrate 42, a conductive layer 43 comprising indium tin oxide dispersed in a polymeric binder, an optional adhesive layer 44, a siloxane film charge blocking layer 45, an infrared or red light radiation sensitive layer 46 comprising infrared or red light radiation sensitive pigment particles 47 optionally dispersed in polymeric binder 48, an optional charge transport layer 49, and a softenable layer 50, said softenable layer 50 comprising softenable material 51,charge transport material 52, and migration marking material 53 situated at or near the surface of the layer spaced from the substrate. Optional overcoating layer 54 is situated on the surface of imaging member 41 spaced from the substrate 42. Optional antistatic layer 55 is situated on the surface of substrate 42 opposite to that coated with softenable layer 50.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The optional overcoating layer can be substantially electrically insulating, or have any other suitable properties. The overcoating preferably is substantially transparent, at least in the spectral region where electromagnetic radiation is used for imagewise exposure steps in the imaging process. The overcoating layer is continuous and preferably of a thickness up to about 3 microns. More preferably, the overcoating has a thickness of between about 0.5 and about 2 microns to minimize residual charge buildup. Overcoating layers greater than about 3 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling and imaging. The overcoating layer preferably adheres strongly to the softenable layer to minimize damage. The overcoating layer can also have adhesive properties at its outer surface which provide improved resistance to toner filming during toning, transfer, and/or cleaning. The adhesive properties can be inherent in the overcoating layer or can be imparted to the overcoating layer by incorporation of another layer or component of adhesive material. These adhesive materials should not degrade the film forming components of the overcoating and preferably have a surface energy of less than about 20 ergs/cm$^2$. Typical adhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, and after the members have been imaged.

The optional antistatic layer generally comprises a binder and an antistatic agent. The binder and antistatic agent are present in any effective relative amounts, typically from about 1 to about 30 percent by weight antistatic agent and from about 70 to about 99 percent by weight binder, although the relative amounts can be outside this range. Typical thicknesses for the antistatic layer are from about 0.4 to about 2 microns, and preferably from about 0.4 to about 1 micron, although the thickness can be outside these ranges. The antistatic layer can be applied to the imaging member by any desired method, such as draw bar coating, spray coating, extrusion, dip coating, gravure roll coating, wire-wound rod coating, air knife coating, and the like. In one preferred method, the antistatic layer is coated onto the imaging member by a slot extrusion process, wherein a flat die is situated with the die lips in close proximity to the web of the substrate to be coated, resulting in a continuous film of the coating solution evenly distributed across followed by drying sheet, followed by drying in an air dryer at 100° C.

Any suitable or desired binder can be employed. Examples of suitable binders include (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A. B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A. G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) Karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, avavailable from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly (vinyl phosphate) (such as #4391 available from Poly Sciences Inc.), (3) poly (vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly (vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl alcohol) ethoxylated #6573, available from Poly Sciences Inc.), and (8) poly (vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl pyrrolidone-diethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly (2-acrylamide-2-methyl propane sulfonic acid) (such as #175 available from Scientific Polymer Products), (2) poly (N,N-dimethyl-3,5-dimethylene piperidinium chloride) (such as #401, available from Scientific Polymer Products), and (3) poly (methylene-guanidine) hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylene-vinylacetate latex (such as Airflex 400, available from Air Products and Chemicals Inc.), (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals; (4) quaternary acrylic copolymer latexes, particularly those of the formula

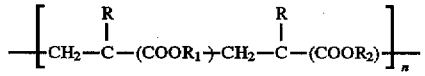

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like; (f) maleic anhydride and maleic acid containing polymers, such as (1)

styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporation as Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (g) acrylamide containing polymers, such as (1) poly (acrylamide) (such as #02806, available from Poly Sciences Inc.), (2) acrylamide-acrylic acid copolymers (such as #04652, #02220, and #18545, available from Poly Sciences Inc.), and (3) poly (N,N-dimethyl acrylamide) (such as #004590, available from Poly Sciences Inc.); and (h) poly (alkylene imine) containing polymers, wherein alkylene has two (ethylene), three (propylene), or four (butylene) carbon atoms, such as (1) poly(ethylene imine) (such as #135, available from Scientific Polymer Products), (2) poly (ethylene imine) epichlorohydrin (such as #634, available from Scientific Polymer Products), and (3) alkoxylated poly (ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like. Any mixtures of the above ingredients in any relative amounts can also be employed.

Any desired or suitable antistatic agent can be employed. Indium tin oxide is a particularly preferred antistatic agent.

In one particularly preferred embodiment of the present invention, the migration imaging member is prepared with a substrate which comprises a polyester (such as ICI 054 or ICI 454) with a thickness of about 4.0 mils and is coated on both surfaces with conductive layers each having a thickness of from about 0.4 to about 1 micron and comprising indium tin oxide dispersed in a binder. This three layered article is available from Arkwright Inc., Fiskeville, R.I., as SUPER CLEAR 106. The three-layered article is then coated on one surface with the softenable layer (and any other desired optional layers), with the exposed surface of the three-layered article subsequent to coating functioning as an antistatic layer. The resistance of SUPER CLEAR 106 is generally from about $3\times10^6$ to about $5\times10^6$ ohm/cm$^2$.

Imaging members of the present invention are exposed and developed by known processes, such as those disclosed in, for example, U.S. Pat. No. 5,215,838 (Tam et al.), the disclosure of which is totally incorporated herein by reference. In one embodiment of the present invention the imaging member can be developed by a process which comprises uniformly charging the imaging member, exposing the charged member to activating radiation at a wavelength to which the migration marking material is sensitive in an imagewise pattern, thereby forming an electrostatic latent image on the imaging member, and thereafter causing the softenable material to soften, thereby enabling the migration marking material to migrate through the softenable material toward the substrate in an imagewise pattern. In embodiments of the present invention wherein the migration imaging member contains an infrared or red light sensitive material, the member can be developed by a process which comprises uniformly charging the imaging member, exposing the charged imaging member to infrared or red light radiation at a wavelength to which the infrared or red light radiation sensitive pigment is sensitive in an imagewise pattern, thereby forming an electrostatic latent image on the imaging member, uniformly exposing the imaging member to activating radiation at a wavelength to which the migration marking material is sensitive, and causing the softenable material to soften, thereby enabling the migration marking material to migrate through the softenable material toward the substrate in an imagewise pattern.

In a preferred embodiment, the present invention includes an imaging process which comprises (1) providing a migration imaging member which comprises (a) a substrate, (b) a conductive layer comprising indium tin oxide dispersed in a polymeric binder, (c) a siloxane film charge blocking layer, and (d) a softenable layer comprising a softenable material and a photosensitive migration marking material; (2) uniformly charging the migration imaging member; (3) exposing the charged migration imaging member to a source of activating radiation in an imagewise pattern; (4) causing the softenable material to soften, thereby enabling the migration marking material to migrate through the softenable material toward the conductive layer in an imagewise pattern; (5) providing a printing plate precursor which comprises a base layer and a layer of photosensitive material selected from the group consisting of photohardenable materials and photosoftenable materials; and (6) exposing the printing plate precursor and the migration imaging member wherein the migration marking material has migrated toward the substrate in an imagewise fashion to radiation at a wavelength to which the photosensitive material on the printing plate precursor is sensitive, wherein substantially all of the radiation to which the printing plate precursor is exposed passes first through the migration imaging member, thereby causing the photosensitive material on the printing plate precursor to harden or soften in areas situated contiguous with light-transmissive areas of the migration imaging member, thereby forming an imaged printing plate. In a particularly preferred embodiment, the printing plate precursor is exposed to radiation at a wavelength in the ultraviolet wavelength range, specifically from about 300 to about 500 nanometers. Examples of suitable printing plate materials and configurations are disclosed in, for example, U.S. Pat. No. 5,102,756 (Vincett et al.), the disclosure of which is totally incorporated herein by reference.

In another preferred embodiment, the present invention includes an imaging process which comprises (1) providing a migration imaging member which comprises (a) a substrate, (b) a conductive layer comprising indium tin oxide dispersed in a polymeric binder, (c) a siloxane film charge blocking layer, and (d) a softenable layer comprising a softenable material and a photosensitive migration marking material; (2) uniformly charging the migration imaging member; (3) exposing the charged migration imaging member to a source of activating radiation in an imagewise pattern; (4) causing the softenable material to soften, thereby enabling the migration marking material to migrate through the softenable material toward the conductive layer in an imagewise pattern; (5) providing a photosensitive film; and (6) exposing the photosensitive film and the migration imaging member wherein the migration marking material has migrated toward the substrate in an imagewise fashion to radiation at a wavelength to which the photosensitive material on the printing plate precursor is sensitive, wherein substantially all of the radiation to which the photosensitive film is exposed passes first through the migration imaging member, thereby forming an image on the photosensitive film. In a particularly preferred embodiment, the photosensitive film is exposed to radiation at a wavelength in the ultraviolet wavelength range, specifically from about 300 to about 500 nanometers.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A 4 mil thick polyester sheet (ICI 454) measuring 6 inches×12.5 inches was coated on both sides with indium tin oxide dispersed in a polymeric binder (Super Clear 106, obtained from Arkwright Inc.). The film exhibited a resistivity of $3.5\times10^6$ ohms per square centimeter. Thereafter a charge blocking layer was applied to one of the conductive indium tin oxide layers by coating one surface of the sheet with a solution containing 2.5 percent by weight hydrolized 3-aminopropyltriethoxysilane in a solvent mixture of ethanol and n-heptane (solvent containing 75 percent by weight ethanol and 25 percent by weight n-heptane) using a CSD draw down table and a Consler coating rod #10. The wet film was then mounted on an aluminum heat block set to 100° C. for 60 seconds to dry. Subsequently a solution containing 15 percent by weight of a terpolymer of styrene/ethylacrylate/acrylic acid (prepared as disclosed in U.S. Pat. No. 4,853,307, the disclosure of which is totally incorporated herein by reference) in toluene was coated on the charge blocking layer using a CSD draw down table and a Consler coating rod #10. The deposited softenable layer was allowed to dry at about 115° C. for about 2 minutes, resulting in a dried softenable layer with a thickness of about 4 microns. Onto a donor sheet of 3 mil thick polyester (Melinex 442, obtained from Imperial Chemical Industries (ICI), aluminized to 20 percent light transmission) was coated a solution containing 15 percent by weight of a terpolymer of styrene/ethylacrylate/acrylic acid (prepared as disclosed in U.S. Pat. No. 4,853,307, the disclosure of which is totally incorporated herein by reference) in toluene using a CSD draw down table and a Consler coating rod #10. The deposited softenable layer was allowed to dry at about 115° C. for about 2 minutes, resulting in a dried softenable layer with a thickness of about 4 microns. Thereafter, the temperature of the softenable layers on the imaging member and on the donor sheet were raised to about 115° C. to lower the viscosity of the exposed surfaces of the softenable layers to about $5\times10^3$ poises in preparation for the deposition of marking material. Thin layers of particulate vitreous selenium were then applied by vacuum deposition in a vacuum chamber maintained at a vacuum of about $4\times10^{-4}$ Torr. The imaging member and the donor sheet were then rapidly chilled to room temperature. Reddish monolayers of selenium particles having an average diameter of about 0.3 micron embedded about 0.05 to 0.1 micron below the surfaces of the copolymer layers were formed. The selenium-coated softenable layer of the imaging member was then placed in contact with the selenium-coated softenable layer on the donor sheet, and the "sandwich" thus formed was fed between the two heated pressure rollers in an AGFA ADL 45 laminator. The heater in the laminator was set to 100° C., and the measured surface temperature of the top and bottom rollers was 80° to 85° C. The roller speed was 50 centimeters per minute. Thereafter, when the laminated imaging member had cooled to room temperature, the aluminized polyester donor sheet was peeled from the member at a 180 degree angle using a continuous smooth motion, resulting in formation of an imaging member having two softenable layers containing migration marking material.

The migration imaging member thus prepared was then uniformly placed on a charge table ($I_{table}$=−40 μA) moving at 88 inches per minute and grounded with copper tape. The imaging member was negatively charged to a surface voltage of −625 V with a corona charging device set at −6.1 KV and set at a height of 6.3 millimeters at a temperature between 21° and 24° C.; a relative humidity of 23 to 33 percent, and with room lights off and red safe lights on. The charged member was subsequently optically exposed by placing a test pattern mask comprising a UGRA 1982 target silver halide image in contact with the imaging member in a small vacuum frame to hold the target mask in intimate contact with the member and exposing the member to blue light of 480 nanometers through the mask for a period of 6 seconds. The exposed imaging member was then developed by subjecting it to a temperature of 115° C. for 5 seconds using a small aluminum heating block in contact with the surface of the sheet spaced from the softenable layer. The optical density of the imaging member in the $D_{max}$ and $D_{min}$ area were measured using a MacBeth TR927 densitometer. The blue setting corresponds to a Wratten No. 47 filter and the ultraviolet setting corresponds to a Wratten No. 18A filter. The film exhibited a $D_{min}$ of 0.75 and an optical contrast of 2.08 for blue, and a $D_{min}$ of 0.75 and an optical contrast of 2.03 for UV light. The image was also assessed using a 10×loupe, and the resulting images were of high quality.

EXAMPLE II

The procedure of Example I was repeated with the exception that no charge blocking layer was applied to the imaging member. The film exhibited a $D_{min}$ of 2.35 and an optical contrast of 0.67 for blue, and a $D_{min}$ of 2.28 and an optical contrast of 0.68 for UV light.

EXAMPLE III

The procedure of Example I was repeated with the exception that the siloxane charge blocking layer was replaced with a charge blocking layer applied by coating a solution containing 5 percent by weight gelatin from swine skin in water. The film exhibited a $D_{min}$ of 0.77 and an optical contrast of 2.16 for blue, and $D_{min}$ of 0.77 and an optical contrast of 2.02 for UV light. The film had very poor mechanical properties as a result of poor adhesion of the gelatin charge blocking layer to the substrate.

EXAMPLE IV

The procedure of Example I was repeated with the exception that the siloxane charge blocking layer was replaced with a charge blocking layer applied by coating a solution containing 5 percent by weight (poly(2-hydroxyethylmethacrylate) in methanol. The film exhibited a $D_{min}$ of 2.69 and an optical contrast of 0.35 for blue, and a $D_{min}$ of 2.59 and an optical contrast of 0.29 for UV light.

EXAMPLE V

The procedure of Example I was repeated with the exception that the siloxane charge blocking layer was replaced with a charge blocking layer applied by coating a solution containing 5 percent by weight poly(vinyl acetate) in methanol. The film exhibited a $D_{min}$ of 2.75 and an optical contrast of 0.27 for blue, and a $D_{min}$ of 2.66 and an optical contrast of 0.27 for UV light.

EXAMPLE VI

The procedure of Example I was repeated with the exception that the siloxane charge blocking layer was replaced with a charge blocking layer applied by coating a solution containing 5 percent by weight (poly(2-hydroxypropylmethaacrylate) in methanol. The film exhibited a $D_{min}$ of 2.60 and an optical contrast of 0.41 for blue, and a $D_{min}$ of 2.53 and an optical contrast of 0.38 for UV light.

EXAMPLE VII

The procedure of Example I was repeated with the exception that no softenable layer was solution coated onto the charge blocking layer. Instead, a softenable layer was applied to a first donor sheet by the procedure described in Example I. A second donor sheet was then placed in contact with the selenium-coated softenable layer on the first donor sheet and the "sandwich" thus formed was passed through the laminator, followed by removal of the first donor sheet. The second donor sheet was then placed in contact with the charge blocking layer of the imaging member and the "sandwich" thus formed was passed through the laminator, followed by removal of the second donor sheet, resulting in formation of an imaging member having a single softenable layer with selenium particles situated at or near the surface of the softenable layer spaced from the charge blocking layer. The film exhibited a $D_{min}$ of 0.53 and an optical contrast of 0.95 for blue, and a $D_{min}$ of 0.53 and an optical contrast of 0.83 for UV light.

EXAMPLE VIII

The procedure of Example I was repeated with the exception that subsequent to application of the siloxane charge blocking layer, a pigment dispersion was prepared by ball milling for 24 hours a mixture comprising 10.6 parts by weight solids in an n-butyl acetate solvent, wherein the solids comprised 5 percent by weight X-metal-free phthalocyanine (prepared as described in U.S. Pat. No. 3,357,989, the disclosure of which is totally incorporated by reference) and 95 percent by weight of an ethylene vinyl acetate/vinyl chloride-vinyl acetate copolymer. The resulting dispersion was hand coated onto the charge blocking layer of the migration imaging member with a #5 Meyer rod, followed by drying the deposited infrared-sensitive layer at 50° C. for 1 minute by contacting the substrate to an aluminum heating block. The two softenable layers each contained about 76 percent by weight of the terpolymer and about 24 percent by weight of a tritolylamine charge transfer material prior to vacuum evaporation of the selenium particles onto the softenable layers. The film exhibited a $D_{min}$ of 0.80 and an optical contrast of 2.20 for blue. and a $D_{min}$ of 0.87 and an optical contrast of 1.95 for UV light.

EXAMPLE IX

The procedure of Example I was repeated with the exception that the indium tin oxide coated substrate was replaced with a substrate comprising 4 mil polyester film (ICI 454) coated with copper iodide. No image was obtained subsequent to exposure and development.

EXAMPLE X

The procedure of Example I was repeated with the exception that the indium tin oxide coated substrate was replaced with a substrate comprising 4 mil polyester film (ICI 454) coated with copper iodide and the siloxane charge blocking layer was replaced with a charge blocking layer applied by coating a solution containing 5 percent by weight (poly(2-hydroxyethylmethacrylate) in methanol. The film exhibited a $D_{min}$ of 1.79 and an optical contrast of 0.21 for blue, and a $D_{min}$ of 1.72 and an optical contrast of 0.23 for UV light.

EXAMPLE XI

Antistatic tests were performed on a migration imaging member prepared as described in Example I and, for comparison purposes, on a migration imaging member prepared as described in Example I with the exception that the indium tin oxide coating was applied only to one surface of the polyester substrate, followed by coating the indium tin oxide layer with the charge blocking and softenable layers, resulting in formation of a migration imaging member having no indium tin oxide antistatic coating on the surface of the substrate spaced from the softenable layer. The tests were performed using a Princeton Electro Dynamics 276A Static Charge Analyzer. The imaging member without an antistatic coating was charged up to 1,020 volts, and the imaging member retained the charge without decay in 60 seconds. The imaging member with the indium tin oxide antistatic coating was able to be charged to only 50 volts, and decayed to about zero volts in 25 seconds.

EXAMPLE XII

Blocking tests were performed on a migration imaging member prepared as described in Example I and, for comparison purposes, on migration imaging members prepared as described in Example I with the exception that the indium tin oxide coating was applied only to one surface of the polyester substrate and the other surface of the polyester substrate was coated with an antistatic layer comprising a quaternary ammonium salt in a quaternary acrylic copolymer latex binder (relative amounts about 15 percent by weight quaternary ammonium salt and about 85 percent by weight binder). The quaternary ammonium salts used were ammonium chloride, ammonium bromide, and ammonium iodide. The blocking tests were performed on stacks of five 1 inch×1 inch samples of the migration imaging members under the following conditions: 20° C. at 50% relative humidity; 20° C. at 80% relative humidity; 45° C. at 50% relative humidity; and 45° C. at 80% relative humidity. These conditions represent standard storage conditions for migration imaging members, and also represent extreme conditions to which the film may be exposed. The imaging member samples were conditioned under these conditions in a Hotpack Temperature-Humidity Chamber for a period of 24 hours. Thereafter, the sample sets were placed between the jaw of a TWN-16 Super Pillow Block, which was placed inside of the Temperature-Humidity Chamber, and pressed for 24 hours at pressures of 2.6, 5.1, 10.5, and 21.5 kilograms per square inch. The imaging members with the indium tin oxide antistatic coating passed all of these tests without any coating separation from substrate, whereas the imaging members with quaternary ammonium salts as antistatic coating all exhibited significant blocking; transfer of large patches of the antistatic layer of one member to the softenable layer of the adjacent member in the stack was observed for these imaging members containing the quaternary ammonium salt antistatic layers.

EXAMPLE XIII

Migration imaging members prepared as described in Example I were tested for imaging performance. Three stacks each containing five 2.0"×13" portions of the member were placed between two pieces of polished metal plates (2.5"×13.5"). Pressures of 1.15, 2.5 and 3.7 kilograms per square inch were applied to the stacks for 24 hours. No transfer of antistatic coatings to the softenable layers was observed. Thereafter, the imaging members were charged, exposed, and developed as described in Example I. The imaged members each exhibited a $D_{min}$ of 0.75 and an optical contrast of 2.15 for blue light, and a $D_{min}$ of 0.75 and an optical contrast of 2.12 for UV light. The same test was performed on an infrared-sensitive migration imaging member prepared as described in Example VIII. The imaging results were equivalent to those in Example VIII No adverse effects were caused by antistatic coating. After the imaging process, no scratches or fingerprints were observed.

Other embodiments and modifications of the present invention may occur to those skilled in the art subsequent to a review of the information presented herein; these embodiments and modifications, as well as equivalents thereof, are also included within the scope of this invention.

What is claimed is:

1. A migration imaging member which comprises (a) a substrate, (b) a conductive layer comprising indium tin oxide dispersed in a polymeric binder, (c) a siloxane film charge blocking layer comprising a hydrolysis reaction product of a silane of the formula

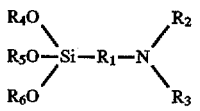

wherein $R_1$ is an alkylidene group, $R_2$ and $R_3$ are each, independent of the other, a hydrogen atom, an alkyl group, a phenyl group, or a poly(ethylene-amino) group, and $R_4$,$R_5$, and $R_6$ are each, independent of the others, alkyl groups, said siloxane having reactive hydroxyl and ammonium groups attached to silicon atoms, and (d) a softenable layer comprising a softenable material and a photosensitive migration marking material.

2. A migration imaging member according to claim 1 wherein the conductive layer has a thickness of from about 0.4 to about 4 microns.

3. A migration imaging member according to claim 1 wherein the conductive layer has a thickness of from about 0.4 to about 1 micron.

4. A migration imaging member according to claim 1 wherein the indium tin oxide is present in the conductive layer in an amount of from about 1 to about 30 percent by weight.

5. A migration imaging member according to claim 1 wherein the indium tin oxide is present in the conductive layer in an amount of from about 3 to about 15 percent by weight.

6. A migration imaging member according to claim 1 wherein the charge blocking layer has a thickness of from about 0.005 to about 2 microns.

7. A migration imaging member according to claim 1 wherein the charge blocking layer has a thickness of from about 0.025 to about 1 micron.

8. A migration imaging member according to claim 1 wherein $R_1$ is an alkylidene group with from 1 to about 20 carbon atoms, $R_2$ and $R_3$ are each, independent of the other, a hydrogen atom, an alkyl group with from 1 to about 3 carbon atoms, a phenyl group, or a poly(ethylene-amino) group, and $R_4$,$R_5$, and $R_6$ are each, independent of the others, alkyl groups with from 1 to about 4 carbon atoms.

9. A migration imaging member according to claim 1 wherein the siloxane is selected from the group consisting of (a) those of the formula

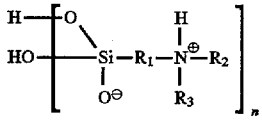

(b) those of the formula

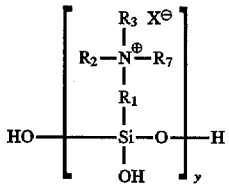

and (c) mixtures thereof, wherein $R_1$ is an alkylidene group, $R_2$ and $R_3$ are each, independent of the other, a hydrogen atom, an alkyl group, a phenyl group, or a poly(ethylene-amino) group, $R_7$ is a hydrogen atom, an alkyl group, or a phenyl group, X is an anion from an acid or acidic salt, n is 1,2, 3, or 4, and y is 1,2,3, or 4.

10. A migration imaging member according to claim 8 wherein $R_1$ is an alkylidene group with from 1 to about 20 carbon atoms, $R_2$ and $R_3$ are each, independent of the other, a hydrogen atom, an alkyl group with from 1 to about 3 carbon atoms, a phenyl group, or a poly(ethylene-amino) group, and $R_7$ is a hydrogen atom, an alkyl group with from 1 to about 3 carbon atoms, or a phenyl group.

11. A migration imaging member according to claim 1 wherein the siloxane is a hydrolysis reaction product of a silane selected from the group consisting of 3-aminopropyl triethoxy silane, N-aminoethyl-3-aminopropyl trimethoxy silane, 3-aminopropyl trimethoxy silane, (N,N'-dimethyl-3-amino) propyl triethoxysilane, (N,N'-diethyl-3-amino) propyl trimethoxysilane, N,N'-dimethylamino phenyl triethoxy silane, N-phenyl aminopropyl trimethoxy silane, N-methyl aminopropyl trimethoxy silane, trimethoxy silylpropyl-diethylene triamine, bis (2-hydroxyethyl) aminopropyl triethoxy silane, N-trimethoxysilyl propyl-N,N-dimethyl ammonium acetate, N-trimethoxysilylpropyl-N,N,N-trimethyl chloride, and mixtures thereof.

12. A migration imaging member according to claim 1 wherein the siloxane is a hydrolysis reaction product of 3-aminopropyl triethoxy silane.

13. A migration imaging member according to claim 1 further comprising an infrared or red light sensitive layer.

14. A migration imaging member according to claim 1 further comprising an antistatic layer comprising indium tin oxide dispersed in a polymeric binder situated on the surface of the substrate spaced from the softenable layer.

15. A migration imaging member according to claim 14 wherein the antistatic layer has a thickness of from about 0.4 to about 2 microns.

16. A migration imaging member according to claim 14 wherein the antistatic layer has a thickness of from about 0.4 to about 1 micron.

17. A migration imaging member according to claim 14 wherein the indium tin oxide is present in the antistatic layer in an amount of from about 1 to about 30 percent by weight.

18. A migration imaging member according to claim 14 wherein the indium tin oxide is present in the antistatic layer in an amount of from about 3 to about 15 percent by weight.

19. A migration imaging member according to claim 1 wherein the imaging member also comprises a second softenable layer containing a second softenable material, a second migration marking material, and an optional charge transport material.

20. An imaging process which comprises (1) providing a migration imaging member which comprises (a) a substrate, (b) a conductive layer comprising indium tin oxide dispersed in a polymeric binder, (c) a siloxane film charge blocking layer comprising a hydrolysis reaction product of a silane of the formula

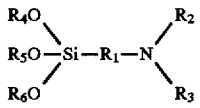

wherein $R_1$ is an alkylidene group, $R_2$ and $R_3$ are each, independent of the other, a hydrogen atom, an alkyl group, a phenyl group, or a poly(ethylene-amino) group, and $R_4$,$R_5$, and $R_6$ are each, independent of the others, alkyl groups, said siloxane having reactive hydroxyl and ammonium groups attached to silicon atoms, and (d) a softenable layer comprising a softenable material and a photosensitive migration marking material; (2) uniformly charging the migration imaging member; (3) exposing the charged migration imaging member to a source of activating radiation in an imagewise pattern; (4) causing the softenable material to soften, thereby enabling the migration marking material to migrate through the softenable material toward the conductive layer in an imagewise pattern; (5) providing a printing plate precursor which comprises a base layer and a layer of photosensitive material selected from the group consisting of photohardenable materials and photosoftenable materials; and (6) exposing the printing plate precursor and the migration imaging member wherein the migration marking material has migrated toward the substrate in an imagewise fashion to radiation at a wavelength to which the photosensitive material on the printing plate precursor is sensitive, wherein substantially all of the radiation to which the printing plate precursor is exposed passes first through the migration imaging member, thereby causing the photosensitive material on the printing plate precursor to harden or soften in areas situated contiguous with light-transmissive areas of the migration imaging member, thereby forming an imaged printing plate.

21. An imaging process according to claim 20 wherein the printing plate precursor is exposed to radiation at a wavelength of from about 300 to about 500 nanometers.

22. An imaging process which comprises (1) providing a migration imaging member which comprises (a) a substrate, (b) a conductive layer comprising indium tin oxide dispersed in a polymeric binder, (c) a siloxane film charge blocking layer comprising a hydrolysis reaction product of a silane of the formula

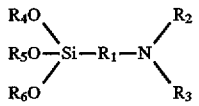

wherein $R_1$ is an alkylidene group, $R_2$ and $R_3$ are each, independent of the other, a hydrogen atom, an alkyl group, a phenyl group, or a poly(ethylene-amino) group, and $R_4$, $R_5$, and $R_6$ are each, independent of the others, alkyl groups, said siloxane having reactive hydroxyl and ammonium groups attached to silicon atoms, and (d) a softenable layer comprising a softenable material and a photosensitive migration marking material; (2) uniformly charging the migration imaging member; (3) exposing the charged migration imaging member to a source of activating radiation in an imagewise pattern; (4) causing the softenable material to soften, thereby enabling the migration marking material to migrate through the softenable material toward the conductive layer in an imagewise pattern; (5) providing a photosensitive film; and (6) exposing the photosensitive film and the migration imaging member wherein the migration marking material has migrated toward the substrate in an imagewise fashion to radiation at a wavelength to which the photosensitive material on the printing plate precursor is sensitive, wherein substantially all of the radiation to which the photosensitive film is exposed passes first through the migration imaging member, thereby forming an image on the photosensitive film.

23. An imaging process according to claim 22 wherein the photosensitive film is exposed to radiation at a wavelength of from about 300 to about 500 nanometers.

* * * * *